US008041283B2

(12) United States Patent
Murai

(10) Patent No.: US 8,041,283 B2
(45) Date of Patent: Oct. 18, 2011

(54) SHEET FEEDING DEVICE AND IMAGE READING DEVICE

(75) Inventor: Shunji Murai, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 768 days.

(21) Appl. No.: 12/037,659

(22) Filed: Feb. 26, 2008

(65) Prior Publication Data

US 2008/0205952 A1 Aug. 28, 2008

(30) Foreign Application Priority Data

Feb. 28, 2007 (JP) ..... 2007-049163

(51) Int. Cl.
*G03G 15/00* (2006.01)

(52) U.S. Cl. ..... 399/367; 399/369; 271/188; 271/209

(58) Field of Classification Search ..... 399/367, 399/369; 271/188, 221, 224, 209
See application file for complete search history.

(56) References Cited

U.S. PATENT DOCUMENTS

| | | | | |
|---|---|---|---|---|
| 5,249,793 | A * | 10/1993 | Scheufler | 271/220 |
| 5,511,770 | A | 4/1996 | Okazaki | |
| 6,073,925 | A * | 6/2000 | Sato | 271/171 |
| 6,128,455 | A * | 10/2000 | Horiguchi et al. | 399/124 |
| 6,654,586 | B2 * | 11/2003 | Lyon et al. | 399/367 |
| 7,793,928 | B2 * | 9/2010 | Ohama et al. | 271/121 |
| 2005/0194731 | A1 | 9/2005 | Ohama et al. | |
| 2005/0212195 | A1 | 9/2005 | Ohama et al. | |
| 2005/0281598 | A1 | 12/2005 | Hattori et al. | |

FOREIGN PATENT DOCUMENTS

| | | | |
|---|---|---|---|
| JP | S59-139060 | A | 8/1984 |
| JP | H0-61069659 | A | 4/1986 |
| JP | S62-197630 | U | 12/1987 |
| JP | H01-094948 | U | 6/1989 |
| JP | H07-008356 | U | 2/1995 |
| JP | H08-091674 | A | 4/1996 |
| JP | H09-030708 | A | 2/1997 |
| JP | 10-218458 | A | 8/1998 |
| JP | 11-193163 | A | 7/1999 |
| JP | 2005247575 | A | 9/2005 |
| JP | 2005253013 | A | 9/2005 |
| JP | 2006-003649 | A | 1/2006 |

OTHER PUBLICATIONS

Japan Patent Office, Notification of Reasons for Refusal in Japanese Patent Application No. 2008-049163 (counterpart of the above-captioned U.S. Patent Application) mailed Jan. 20, 2009.

* cited by examiner

*Primary Examiner* — Matthew G Marini
(74) *Attorney, Agent, or Firm* — Baker Botts L.L.P.

(57) ABSTRACT

A sheet feeding device, including: a first tray on which sheets to be fed are stacked; a second tray which is disposed above the first tray to provide a two-tier structure and on which the sheets after having fed from the first tray are stacked; a sheet-feed path extending from the first tray to the second tray; a sheet-feed mechanism which is operable to separate one of the sheets stacked on the first tray, to feed the one of the sheets into the sheet-feed path, and to discharge the one of the sheets to the second tray such that the one of the sheets slides under another of the sheets that has been discharged immediately before the one of the sheets; and at least one sheet guide which is configured to warp the sheets discharged to the second tray, in a direction perpendicular to a sheet-feed direction in which the sheets are fed.

12 Claims, 11 Drawing Sheets

SHEET FEEDING DEVICE AND IMAGE READING DEVICE

CROSS REFERENCE TO RELATED APPLICATION

The present application claims priority from Japanese Patent Application No. 2007-049163, which was filed on Feb. 28, 2007, the disclosure of which is herein incorporated by reference in its entirety.

BACKGROUND OF THE INVENTION

1. Field of the Invention

The present invention relates to a sheet feeding device which feeds sheets from a first tray to a second tray via a sheet-feed path and in which a sheet is discharged to the second tray such that the sheet slides under another sheet that has been fed immediately before the sheet.

2. Discussion of Related Art

There has been conventionally known an image reading device, such as a copying machine or a scanner, that is equipped with an auto document feeder (hereinafter abbreviated as "ADF"). The ADF is configured to feed document sheets in a sheet-feed direction from a sheet-supplying tray on which the document sheets before being fed are stacked, to a sheet-receiving tray on which the document sheets after having been fed from the first tray are stacked. The image reading device is often equipped with a flat bed scanner (hereinafter abbreviated as "FBS"), in addition to the ADF. For instance, the ADF is provided on a document cover of the FBS. A user selectively uses the ADF and the FBS depending upon an intended operation that is to be performed. Where image reading is performed on a plurality of document sheets, for instance, the ADF is preferably used.

The ADF is often constructed to have a two-tier structure in which the sheet-supplying tray and the sheet-receiving tray are superposed on each other. Further, in the ADF, there is formed, as a sheet-fed path extending from the sheet-supplying tray to the sheet-receiving tray, a so-called U-turned path through which a document sheet is fed while being turned around. Where the sheet-supplying tray is disposed below the sheet-receiving tray, the document sheet which has been fed from the sheet-supplying tray into the sheet-feed path is turned around upward and finally discharged to the sheet-receiving tray. Accordingly, where the document sheet is placed facedown on the sheet-supplying tray, the document sheet is discharged faceup on the sheet-receiving tray.

Where the image reading is performed successively on a plurality of document sheets using the ADF, it is preferable that the order of the document sheets before the image reading be maintained the same as the order of the document sheets after the image reading. Further, it is preferable that the image reading be performed on the plurality of document sheets sequentially from an initial or first page of the document sheets. Where the plurality of document sheets are placed facedown on the sheet-supplying tray, for instance, the first-page document sheet is located at a lowermost position in the document sheets stacked on the sheet-supplying tray. In this instance, there is employed a sheet-feed system in which the document sheets stacked on the sheet-supplying tray are fed in order such that the document sheet which is located at the lowermost position in the stack of the document sheets is first separated from the stack of the document sheets and fed to the sheet-feed path.

As described above, the document sheets which have been fed through the U-turned sheet-feed path for the image reading are discharged faceup on the sheet-receiving tray. Accordingly, in order to collate the discharged document sheets such that the first-page document discharged first to the sheet-receiving tray is located at an uppermost position in the document sheets to be stacked on the sheet-receiving tray after having been discharged, the document sheets to be discharged subsequent to the first-page document sheet need to be stacked such that one document sheet slides under another document sheet that has been discharged immediately before that one document sheet. Patent Publication Document 1 (U.S. 2005/0194731 A1 corresponding to JP-A-2005-253013) and Patent Publication Document 2 (U.S. 2005/0212195 A1 corresponding to JP-A-247575) disclose a sheet feeder equipped with the ADF that realizes such a function.

SUMMARY OF THE INVENTION

In the ADF that employs the above-described sheet-feed system, the document sheets which are successively discharged to the sheet-receiving tray receive a load from the document sheets which are already stacked on the sheet-receiving tray after having been discharged. Where the weight of the document sheets stacked on the sheet-receiving tray increases with an increase in the number of the discharged and stacked sheets, for instance, friction resistance that is received by the document sheets to be subsequently discharged thereafter inevitably increases. Further, where the document sheets stacked on the sheet-receiving tray are warped in the sheet-feed direction, namely, where the discharged document sheets stacked on the sheet-receiving tray droop downwardly, the document sheets to be subsequently discharged receive a load at leading end portions thereof due to a contact with the drooped document sheets. In particular when the length of the sheet-receiving tray as measured in the sheet-feed direction is made small in an attempt to enhance the usability and the viewability of the sheet-supplying tray, the load due to the warpage or drooping of the document sheets is outstandingly increased.

The load that acts on the document sheets as described above inevitably limits a number of the document sheets that can be discharged by the ADF successively and smoothly to the sheet-receiving tray. However, it is desirable that a number of the document sheets that can be fed successively by the ADF be as large as possible. Moreover, it is desirable that the document sheets be discharged to the sheet-receiving stay with high stability, without a risk of falling off from the sheet-receiving tray and a risk of being bent.

It is therefore a first object of the invention to provide a sheet feeding device which is configured such that each of document sheets to be successively discharged to a sheet-receiving tray smoothly slides under document sheets that have been already discharged to and stacked on the sheet-receiving tray, thereby ensuring smooth discharging of the document sheets. It is a second object of the invention to provide an image reading device that comprises such a sheet feeding device.

The above-indicated first object may be attained according to a first aspect of the invention, which provides a sheet feeding device, comprising: a first tray on which sheets to be fed are stacked; a second tray which is disposed above the first tray to provide a two-tier structure and on which the sheets after having fed from the first tray are stacked; a sheet-feed path extending from the first tray to the second tray; a sheet-feed mechanism which is operable to separate one of the sheets stacked on the first tray, to feed the one of the sheets into the sheet-feed path, and to discharge the one of the sheets to the second tray such that the one of the sheets slides under another of the sheets that has been discharged immediately before the one of the sheets; and at least one sheet guide which is configured to warp the sheets discharged to the second tray, in a direction perpendicular to a sheet-feed direction in which the sheets are fed.

The above-indicated second object may be attained according to a second aspect of the invention, which provides an image reading device comprising: the sheet feeding device according to the above-indicated first aspect of the invention; and an image reading portion configured to read an image recorded on each of the sheets fed through the sheet-feed path.

In the sheet feeding device according to the above-indicated first aspect of the invention and the image reading device according to the above-indicated second aspect of the invention, the sheets stacked on the first tray are separated one by one and sequentially discharged to the second tray through the sheet-feed path, by the sheet-feed mechanism. Described in more detail, the sheet-feed mechanism is operable to separate one of the sheets stacked on the first tray, to feed the one of the sheets into the sheet-feed path, and to discharge the one of the sheets to the second tray such that the one of the sheets slides under another of the sheets that has been discharged immediately before the one of the sheets. Further, the sheet guides are configured to warp the sheets after having been fed through the sheet-feed path, in the direction perpendicular to the sheet-feed direction. According to the arrangement, each of the thus warped sheets is tough and hardly bending in the sheet-feed direction. In the thus warped state, the sheets are discharged to and stacked on the second tray.

Because the sheets which have been discharged to the second tray are warped as described above, a sheet to be subsequently discharged can smoothly slide under the sheets which have been already discharged to and stacked on the second tray. Further, the thus warped sheets on the second tray are prevented from drooping downward at leading end portions thereof that protrude from the second tray, thereby reducing a load to be applied to the feeding of the sheets that are to be discharged thereafter. Accordingly, the plurality of sheets can be smoothly discharged to the second tray, whereby the number of sheets that can be successively fed by the present sheet feeding device can be increased.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be hereinafter described embodiments of the invention with reference to the drawings.

First Embodiment

1. Outline of Image Reading Device

Figure 1:
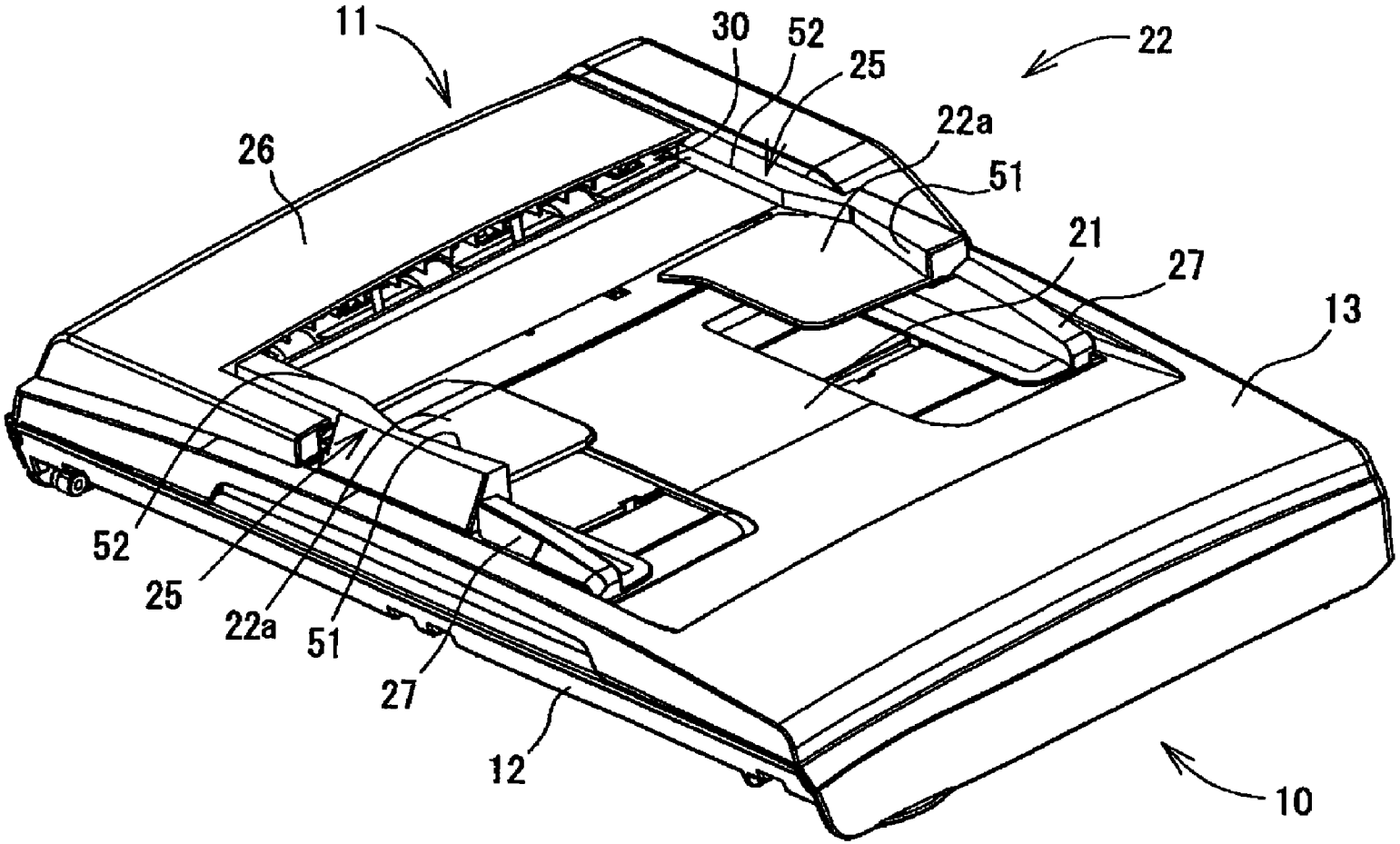
FIG. 1 is a perspective view showing an image reading device according to a first embodiment of the invention.
Figure 2:
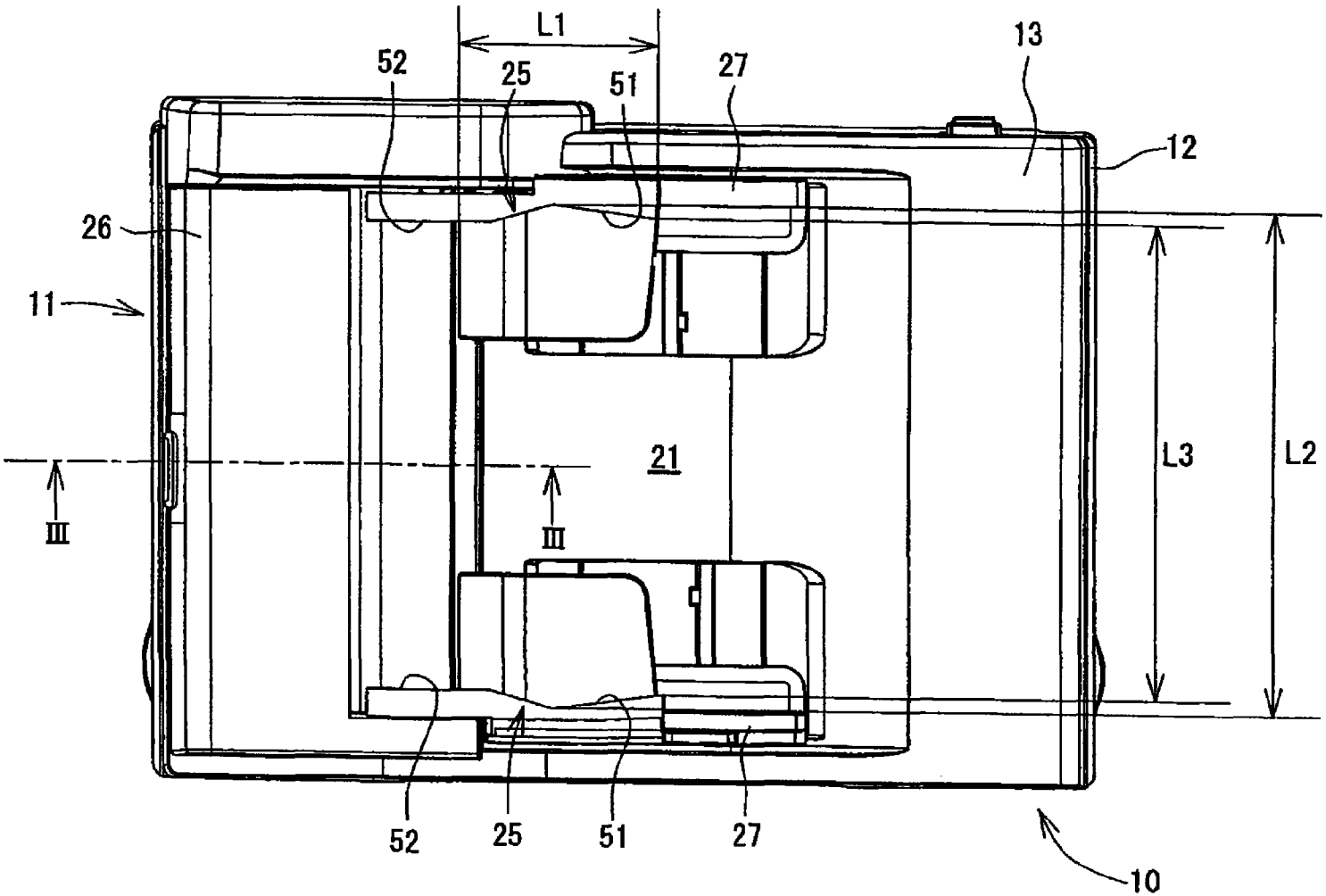
FIG. 2 is a plan view of the image reading device of FIG. 1.
Figure 3:
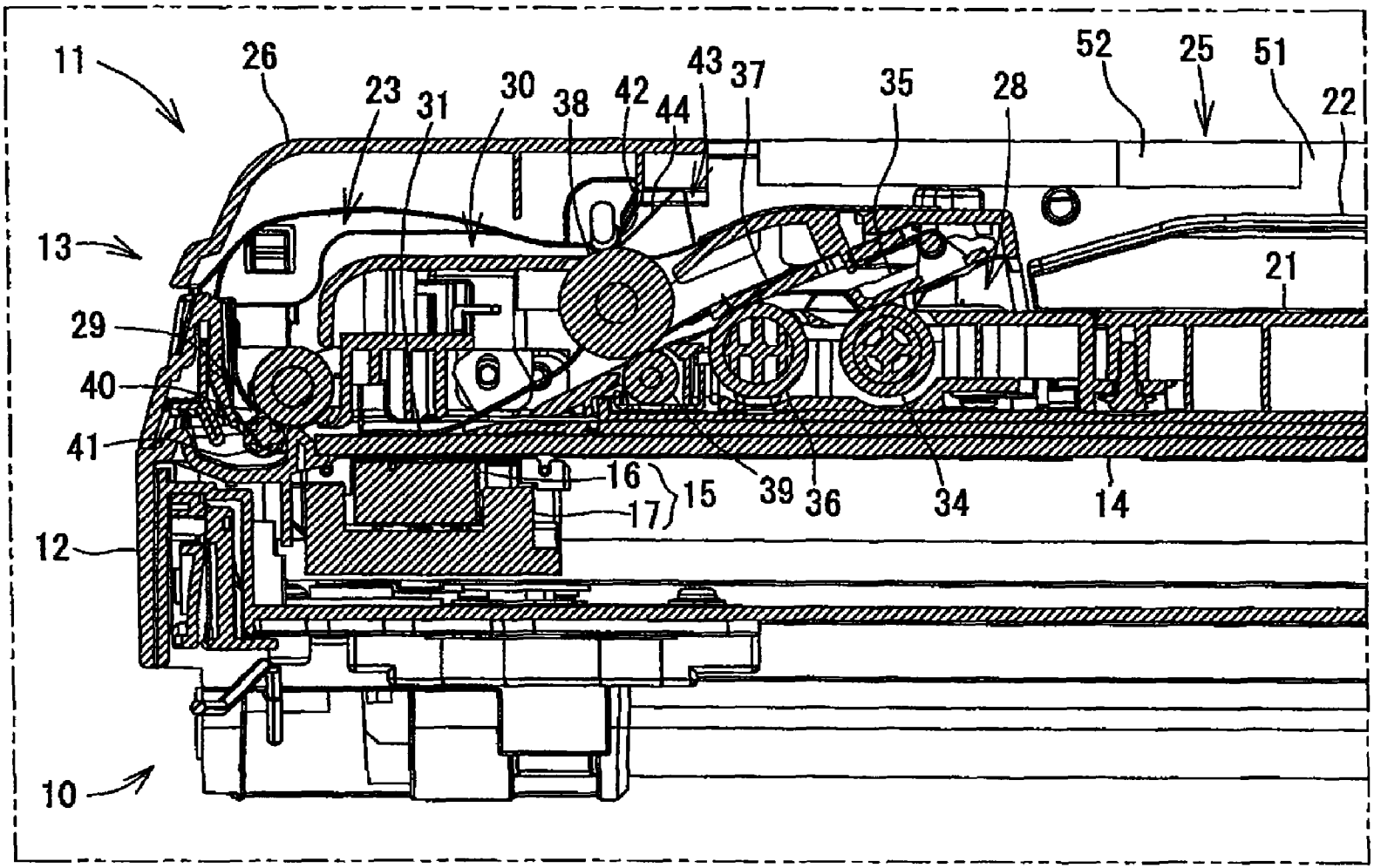
FIG. 3 is an enlarged cross sectional view taken along line III-III in FIG. 1.

Referring first to FIGS. 1-3, there will be explained an image reading device according to a first embodiment of the invention. The image reading device indicated at 10 is a flat bed scanner (FBS) equipped with an auto document feeder (ADF) 11. The sheet feeding device according to the present invention is embodied as the ADF 11. While the image reading device according to the present invention is embodied as the FBS equipped with the ADF 11 in the exemplary first embodiment, the function of the FBS is optional in the image reading device according to the present invention. Moreover, though the image reading device according to the invention is embodied as the image reading device 10 having only an image reading function in the first embodiment, the invention may be otherwise embodied. For instance, the invention may be embodied as a multi-function device having a copying function, a facsimile function, a printing function, etc.

The image reading device 10 includes a document supporting base 12 and a document cover 13. The document supporting base 12 has a platen glass 14 shown in FIG. 3 provided on its upper surface. Where the image reading device 10 is utilized as the FBS, a document sheet to be subjected to image reading is placed on the platen glass 14. Examples of the document sheet include a plain paper, a resin film, etc., on which images and characters are recorded. The platen glass 14 is a transparent glass plate or acrylic plate, for instance, and serves as a reading surface when the image reading is carried out using the ADF 11.

As shown in FIG. 3, an image reading unit 15 is incorporated in the document supporting base 12. The image reading unit 15 includes a contact image sensor (CIS) 16, a carriage 17, and a moving mechanism (a scanning mechanism) not shown. The image reading unit 15 corresponds to an image reading portion in the present invention.

The CIS 16 is an image sensor of a so-called contact type configured to irradiate the document sheet with a light and to convert a reflected light from the document sheet into electric signals. The CIS 16 is mounted on the carriage 17 and held in contact with the platen glass 14. The carriage 17 is configured to be reciprocated in parallel with a lower surface of the platen glass by the moving mechanism. Where the image reading device 10 is utilized as the FBS, the CIS 16 reads an image of the document sheet placed on the platen glass 14 during a sliding movement of the carriage 17 below the platen glass 14. Where the ADF 11 of the image reading device 10 is utilized, the carriage 17 is moved to a prescribed stationary position below a sheet pressing member 31 at which the carriage 17 is kept stationary, and the image of the document sheet passing on the platen glass 14 is read by the CIS 16 that is mounted on the carriage 17 kept at the stationary position.

As shown in FIG. 1, the document cover 13 is coupled to the document supporting base 12 via hinges on a back side of the same 12 (i.e., on an upper right-hand side in FIG. 1). The document cover 13 is pivotally opened and closed about the hinges such that a front end portion of the document cover 13 located opposite to the hinges is moved upward and downward. When the document cover 13 is opened, the platen glass 14 is exposed to an outside. When the document cover 13 is closed, the document sheet placed on the platen glass 14 is fixedly pressed by the document cover 13. When the ADF 11 is utilized, the document cover 13 is kept closed.

2. Overall Structure of ADF

Hereinafter, the structure of the ADF 11 as the sheet feeding device according to the invention will be explained in detail. The ADF 11 is provided on the document cover 13 and includes a sheet-supplying tray 21 as a first tray, a sheet-receiving tray 22 as a second tray, a sheet-feed path 23, a sheet-feed mechanism, and sheet-discharge guides 25 each as a sheet guide.

3. Sheet-Supplying Day

As shown in FIGS. 1 and 2, a portion of the upper surface of the document cover 13 functions as the sheet-supplying tray 21 on which are stacked a plurality of document sheets to be fed. That is, the portion of the upper surface of the document cover 13 is made as a horizontal surface that functions as the sheet-supplying tray 21. The sheet-supplying tray 21 occupies a part of a right-hand portion of the document cover 13 as seen in FIG. 2. Within a casing 26 disposed at a left-hand portion of the document cover 13 as seen in FIG. 2, the sheet-feed path 23 and the sheet-feed mechanism are provided. The plurality of document sheets are placed on the sheet-supplying tray 21 with leading end portions of the document sheets as seen in a sheet-feed direction being inserted into the casing 26. The sheet-feed direction is a direction in which the document sheets are fed.

The sheet-supplying tray 21 is provided with a pair of sheet-supply guides 27, 27 as a pair of third guides which are spaced apart from each other in a depth direction of the image reading device 10 corresponding to the vertical direction in FIG. 2. The sheet-supply guides 27 stand upright from the sheet-supplying tray 21 and extend in the sheet-feed direction. The sheet-supply guides 27 are slidably movable in the depth direction of the image reading device 10, namely, in a direction perpendicular to the sheet-feed direction. The sliding movement of the sheet-supply guides 27 is realized by a known interlock mechanism using rack gears and pinion gears. The sheet-supply guides 27 are configured to move interdependently with each other. That is, when one of the sheet-supply guides 27 is slidably moved, the other of the sheet-supply guides 27 is slidably moved simultaneously in a direction opposite to the direction in which the one sheet-supply guide 27 is moved. In other words, the two sheet-supply guides 27 can be moved at a time as a unit. Accordingly, a distance between the two sheet-supply guides 27 as measured in the direction perpendicular to the sheet-feed direction is changed by sliding only one of the two sheet-supply guides 27. In the present embodiment, the direction perpendicular to the sheet-feed direction corresponds to a width direction of the documents sheets to be fed through the sheet-feed path 23.

Described more specifically, where the width of the document sheet (as measured in the direction perpendicular to the sheet-feed direction) is small, one of the sheet-supply guides 27 disposed near a front side of the image reading device 10 (i.e., a lower side in FIG. 2) is slid toward a back side of the device 10 (i.e., an upper side in FIG. 2), whereby the other of the sheet-supply guides 27 disposed near the back side of the device 10 is simultaneously slid toward the front side of the device 10. As a result, the two sheet-supply guides 27 are moved toward each other relative to a substantially middle portion of the device 10 in the depth direction thereof, so that the distance between the two sheet-supply guides 27 is decreased. Where the width of the document sheet is large, one of the sheet-supply guides 27 disposed near the front side of the device 10 is slid toward the front side of the device 10, whereby the other of the sheet-supply guides 27 disposed near the back side of the device 10 is simultaneously slid toward the back side of the device 10. As a result, the two sheet-supply guides 27 are moved away from each other relative to the substantially middle portion of the device 10 in the depth direction thereof, so that the distance between the two sheet-supply guides 27 is increased. Thus, the two sheet-supply guides 27 are configured to be located at respective slide positions corresponding to the width of the document sheets to be fed. The two sheet-supply guides 27 thus located at the respective slide positions are configured to be held in contact with corresponding widthwise opposite side edges of each of the document sheets stacked on the sheet-supplying tray 21, so that the document sheets stacked on the sheet-supplying tray 21 are positioned with respect to the substantially middle portion of the device 10 in its depth direction.

4. Sheet-Receiving Tray

As shown in FIGS. 1 and 2, the sheet-receiving tray 22 is disposed above the sheet-supplying tray 21 so as to provide a two-tier structure. The plurality of document sheets are stacked on or received by the sheet-receiving tray 22 after having been fed through the sheet-feed path 23. The sheet-receiving tray 22 consists of a pair of tray plates 22*a*, 22*a* which are formed integrally with the pair of sheet-supply guides 27, 27. That is, the tray plates 22*a* are flat plates protruding from the corresponding sheet-supply guides 27 in mutually opposite directions. The sheet-receiving tray 22 is spaced apart from the sheet-supplying tray 21 in the vertical direction. The distance between the sheet-supplying tray 21 and the sheet-receiving tray 22 is determined depending upon a thickness of the plurality of document sheets stacked on the sheet-supplying tray 21 and the operability of the sheet-supplying tray 21. A shown in FIG. 2, a dimension (length) L1 of the sheet-receiving tray 22 as measured in the sheet-feed direction is made smaller than a dimension (length) of the document sheets as measured in the sheet-feed direction. While the ADF 11 is capable of feeding document sheets of various sizes having different dimensions (lengths) in the sheet-feed direction, such as an A4 size and a B5 size, the dimension (length) L1 of the sheet-receiving tray 22 is made smaller at least than a dimension (length) of a document sheet with a maximum size that can be fed by the ADF 11, as measured in the sheet-feed direction. It is needless to mention that the dimension (length) L1 of the sheet-receiving tray 22 may be made smaller than a dimension (length) of a document sheet with a minimum size that can be fed by the ADF 11, as measured in the sheet-feed direction. The arrangements facilitate placing the document sheets on the sheet-supplying tray 21 disposed below the sheet-receiving tray 22. Further, the sheet-supplying tray 21 is easily visible and identifiable.

5. Sheet-Feed Path

As shown in FIG. 3, the sheet-feed path 23 extends from the sheet-supplying tray 21 to the sheet-receiving tray 22. In the cross-sectional view of FIG. 3, the sheet-feed path 23 has a generally U-like configuration. Each of the document sheets on the sheet-supplying tray 21 is fed through the sheet-feed path 23 so at to be turned around upwardly and guided to the sheet-receiving tray 22. The sheet-feed path 23 is defined by the casing 26, suitable ribs, and so on, as a space through which a document sheet is capable of passing. The sheet-feed path 23 is roughly divided into three portions including a pull-in chute portion 28, a curved portion 29, and a discharge chute portion 30 which are arranged in this order as seen from an upstream side in the sheet-feed direction.

The sheet-feed path 23 passes over the platen glass 14 between the pull-in chute portion 28 and the discharge chute portion 30. At a position in the sheet-feed path 23 facing the platen glass 14, the sheet-feed path 23 is open to the platen glass 14, namely, the sheet-feed path 23 is partially defined by the platen glass 14. According to the arrangement, each document sheet being fed through the sheet-feed path 23 is opposed to the platen glass 14.

In the sheet-feed path 23, the sheet pressing member 31 is provided so as to be opposed to the platen glass 14. The sheet pressing member 31 is swingable in directions toward and away from the platen glass 14 and is forced downward by elastic force of a spring not shown. The sheet pressing member 31 is normally spaced apart from the platen glass 14 by a prescribed minimum distance. In this state, the sheet pressing member 31 is located in the closest vicinity of the platen glass 14. The prescribed minimum distance between the sheet pressing member 31 and the platen glass 14 is defined by projections and the like, for instance. When received an external force, the sheet pressing member 31 is retracted upward against the elastic force of the spring. Each document sheet being fed through the sheet-feed path 23 is guided by the sheet pressing member 31 and passes through a space between the platen glass 14 and the sheet pressing member 31 that corresponds to a prescribed distance.

6. Sheet-Feed Mechanism

As shown in FIG. 3, there are provided, in the sheet-feed path 23, a pull-in roller 34 and a nip member 35, a separation roller 36 and a nip member 37, a feed roller 38 and a pinch roller 39, a feed roller 40 and a pinch roller 41, a pinch roller 42, and a trailing-end supporting member 43, which are disposed in order as seen from the upstream side in the sheet-feed direction. Those elements constitute the sheet-feed mechanism of the ADF 11. Further, the combination of the pull-in roller 34 and the nip member 35 and the combination of the separation roller 36 and the nip roller 37 constitute a feed portion of the ADF 11. The number and the arrangement of the rollers and the nip members constituting the sheet-feed mechanism are not specifically limited, but may be suitably changed. Further, the nip members may be replaced with pinch rollers. Moreover, any known sheet-feed mechanism may be employed as the sheet-feed mechanism of the ADF 11.

The pull-in roller 34 is rotatably disposed below the pull-in chute portion 28 such that its roller surface is partially exposed into the pull-in chute portion 28. The separation roller 36 is rotatably disposed at a position distant from the pull-in roller 34 in the sheet-feed direction, such that a roller surface of the separation roller 36 is partially exposed into the pull-in chute portion 28. The pull-in roller 34 and the separation roller 36 are rotatably driven by a drive force transmitted from a motor not shown. The pull-in roller 34 and the separation roller 36 have the same diameter and are rotated at the same peripheral speed. A clutch not shown is provided in a transmission path of the drive force to the pull-in roller 34, whereby the pull-in roller 34 is freely rotatable over one circumference.

The nip member 35 is disposed so as to be opposed to the pull-in roller 34 and can come into contact with and separate from the pull-in roller 34. The nip member 35 is forced downward by elastic force of a spring not shown and makes pressing contact with the pull-in roller 34 when the document sheet is not nipped therebetween. The nip member 35 can press the document sheet onto the pull-in roller 34, so that the rotational force of the pull-in roller 34 is transmitted to the document sheet.

The nip member 37 is disposed so as to be opposed to the separation roller 36 and can come into contact with and separate from the separation roller 36. The nip member 37 is forced downward by elastic force of a spring not shown and makes pressing contact with the separation roller 36 when the document sheet is not nipped therebetween. The nip member 37 can press the document sheet onto the separation roller 36, so that the rotational force of the separation roller 36 is transmitted to the document sheet.

The document sheet contacting the pull-in roller 34 and the separation roller 36 is a sheet which is located at a lowermost position in the document sheets stacked on the sheet-supplying tray 21. The lowermost document sheet is separated by the pull-in roller 34 and the separation roller 36 from the stack of the document sheets on the sheet-supplying tray 21, and is fed into the sheet-feed path 23.

The feed roller 38 is disposed so as to be distant from the separation roller 36 in the sheet-feed direction and so as to be located on the upstream side of the position in the sheet-feed path 23 at which the sheet-feed path 23 is opposed to the platen glass 14. The feed roller 38 has an outside diameter that permits its roller surface to be exposed into both of the pull-in chute portion 28 and the discharge chute portion 30. The feed roller 38 is rotatably driven by a drive force transmitted from the motor not shown.

The pinch roller 39 is disposed below the feed roller 38. The pinch roller 39 is rotatably supported by the casing 26 with its axis elastically forced by a spring member. The pinch roller 39 makes pressing contact with the feed roller 38 when the document sheet is not nipped therebetween. When the feed roller 38 is rotated, the pinch roller 39 is also rotated in accordance with the rotation of the feed roller 38. The pinch roller 39 can press the document sheet onto the feed roller 38, so that the rotational force of the feed roller 38 is transmitted to the document sheet.

The feed roller 40 is disposed so as to be distant from the feed roller 38 in the sheet-feed direction and so as to be located on a downstream side of the position in the sheet-feed path 23 at which the sheet-feed path 23 is opposed to the platen glass 14. The feed roller 40 is rotatably driven by a drive force transmitted from the motor not shown.

The pinch roller 41 is disposed below the feed roller 40. The pinch roller 41 is rotatably supported by the casing 26 with its axis elastically forced by a spring member. The pinch roller 41 makes pressing contact with the feed roller 40 when the document sheet is not nipped therebetween. When the feed roller 40 is rotated, the pinch roller 41 is also rotated in accordance with the rotation of the feed roller 40. The pinch roller 41 can press the document sheet onto the feed roller 40, so that the rotational force of the feed roller 40 is transmitted to the document sheet.

The pinch roller 42 is disposed above the feed roller 38. The pinch roller 42 is rotatably supported by the casing 26 with its axis elastically forced by a spring member. The pinch roller 42 makes pressing contact with the feed roller 38 when the document sheet is not nipped therebetween. When the feed roller 38 is rotated, the pinch roller 42 is also rotated in accordance with the rotation of the feed roller 38. The pinch roller 42 can press the document sheet onto the feed roller 38, so that the rotational force of the feed roller 38 is transmitted to the document sheet. The document sheet is discharged to the sheet-receiving tray 22 by the feed roller 38 and the pinch roller 42.

The trailing-end supporting member 43 is disposed on the downstream side of a nip position at which the document sheet is nipped or held by the feed roller 38 and the pinch roller 42. The trailing-end supporting member 43 is formed by bending a spring steel strip. In the cross-sectional view of FIG. 3, the trailing-end supporting member 43 has a triangular shape whose acute apex protrudes upward. In FIG. 3, the apex and the bottom of the triangular shape are hidden behind the casing 26 and the feed roller 38, and are not shown.

The trailing-end supporting member 43 has a guide surface 44 that is an inclined surface facing the feed roller 38 and the pinch roller 42. A lower end of the guide surface 44 is located at a position lower than the nip position at which the document sheet is nipped by the feed roller 38 and the pinch roller 42. An upper end of the guide surface 44 (i.e., the apex of the triangular shape) is located at a position higher than the nip position. The guide surface 44 is inclined such that its lower end is located nearer to the nip position between the feed roller 38 and the pinch roller 42 than its upper end.

The trailing-end supporting member 43 is elastically deformable such that the upper end of the guide surface 44 moves downward. When the leading end of the document sheet nipped by the feed roller 38 and the pinch roller 42 contacts the guide surface 44, the trailing-end supporting member 43 is elastically deformed so as to be pushed downward due to the toughness of the document sheet. After the trailing end portion of the document sheet passes through the nip position between the feed roller 38 and the pinch roller 42, the trailing-end supporting member 43 returns back to its original position and pushes up the trailing end portion of the document sheet to a position higher than the nip position, whereby the trailing end portion of the document sheet is supported by the trailing-end supporting member 43 at the position. Accordingly, a leading end portion of a next document sheet that is to be subsequently discharged by the feed roller 38 and the pinch roller 42 to the sheet-receiving tray 22 is guided by the guide surface 44 and slides under the trailing end portion of the document sheet that has been discharged immediately before the above-indicated next document sheet.

7. Sheet Guides

As shown in FIGS. 1 and 2, the sheet-discharge guides 25, 25 are provided as a pair and formed integrally with the pair of sheet-supply guides 27, 27. Each sheet-discharge guide 25 consists of a first guide portion 51 as a first guide and a second guide portion 52 as a second guide. Each of the document sheets discharged to the sheet-receiving tray 22 is warped by the sheet-discharge guides 25, 25 such that a central portion of the document sheet as seen in the direction perpendicular to the sheet-feed direction (i.e., a widthwise central portion) is located at a higher position than opposite end portions thereof as seen in the direction (i.e., widthwise opposite end portions).

The first guide portions 51 formed as a pair are wall-like members standing upright from the respective tray plates 22*a* of the sheet-receiving tray 22 and extending along the sheet-feed direction. The first guide portions 51 are opposed to each other in the direction perpendicular to the sheet-feed direction. A height of each first guide portion 51 as measured from an upper surface of each tray plate 22*a* is determined depending upon the number of the document sheets that can be stacked on the sheet-receiving tray 22 and so on. The first guide portions 51 are configured such that a distance therebetween gradually becomes smaller toward the downstream side in the sheet-feed direction. Described more specifically with reference to FIG. 2, a distance L2 between the two first guide portions 51 at upstream ends thereof in the sheet-feed direction is larger than a distance L3 between the two first guide portions 51 at downstream ends thereof in the sheet-feed direction. The distance between the two first guide portions 51 gradually changes from the distance L2 as the maximum to the distance L3 as the minimum, namely, gradually becomes smaller from the upstream side toward the downstream side in the sheet-feed direction.

The distance L2 between the two first guide portions 51 at the upstream ends thereof in the sheet-feed direction is the same as the distance between the two sheet-supply guides 27. As explained above, the pair of sheet-discharge guides 25 are formed integrally with the pair of sheet-supply guides 27. Accordingly, when the distance between the sheet-supply guides 27 is changed, the first guide portions 51 are slid in mutually opposite directions perpendicular to the sheet-feed direction, together with the sheet-supply guides 27, whereby the distance L2 between the first guide portions 51 is also changed. That is, the first guide portions 51 are moved together with or interdependently with the sheet-supply guides 27, so as to be moved to and located at respective prescribed slide positions corresponding to the width of the document sheets being fed. The distance L2 between the two first guide portions 51 at the upstream ends thereof in the sheet-feed direction corresponds to the width of the document sheets being fed. Accordingly, the distance between the two first guide portions 51 gradually becomes smaller toward the downstream side in the sheet-feed direction than the width of the document sheets being fed, and becomes equal to the distance L3 at the downstream ends of the first guide portions 51.

The second guide portions 52 are projecting members that project over the respective tray plates 22*a* of the sheet-receiving tray 22. The second guide portions 52 are provided as a pair and opposed to each other. More specifically explained, the second guide portions 52 are opposed to each other in the direction perpendicular the sheet-feed direction. A height level of the second guide portions 52 at which the second guide portions 52 are located over the tray plates 22*a* is determined depending upon the number of the document sheets to be stacked on the sheet-receiving tray 22, a permissible or possible vertical movement of the widthwise opposite end portions of the document sheets, etc. In the present embodiment, the height level of the second guide portions 52 is made substantially equal to a height level of upper ends of the first guide portions 51. An amount (a dimension) by which each second guide portion 52 projects in the direction perpendicular to the sheet-feed direction is determined such that the widthwise opposite end portions of the document sheets discharged to the sheet-receiving tray 22 are prevented from getting over or moving upward beyond the respective second guide portions 52. The second guide portions 52 need not be disposed right over the sheet-receiving tray 22, but may be arranged otherwise so as to allow the widthwise opposite end portions of the document sheets to pass between the second guide portions 52 and the tray plates 22*a* of the sheet-receiving tray 22.

The second guide portions 52 project toward each other in the direction perpendicular to the sheet-feed direction, such that the second guide portions 52 respectively overlie the widthwise opposite end portions of an uppermost one of the document sheets discharged to the sheet-receiving tray 22. As explained above, the pair of sheet-discharge guides 25 are formed integrally with the pair of sheet-supply guides 27. Accordingly, when the distance between the sheet-supply guides 27 is changed, the second guide portions 52 of the respective sheet-discharge guides 25 are slid in mutually opposite directions perpendicular to the sheet-feed direction, together with the sheet-supply guides 27, whereby the distance between the second guide portions 52 is also changed. That is, the second guide portions 52 move together or interdependently with the sheet-supply guides 27, so as to be moved to and located at respective prescribed slide positions corresponding to the width of the document sheets being fed. Accordingly, the second guide portions 52 are capable of overlying the widthwise opposite end portions of the uppermost one of the document sheets discharged to the sheet-receiving tray 22 so as to correspond to various sizes of document sheets. Because the first guide portions 51 move together with the sheet-supply guides 27, the first guide portions 51 and the second guide portions 52 move together with the sheet-supply guides 27. In other words, the first guide portions 51 and the second guide portions 52 move together or interdependently with each other.

The second guide portions 52 disposed as described above define a space therebetween in which no elements or members, such as a part of the casing 26, are present. Accordingly, each of the document sheets ejected from the casing 26 is allowed to be warped upward in the space between the second guide members 52.

8. Sheet Feeding Operation by ADF

With reference to FIGS. 4-7, there will be explained a sheet feeding operation for feeding the document sheets by the ADF 11.

Figure 4:
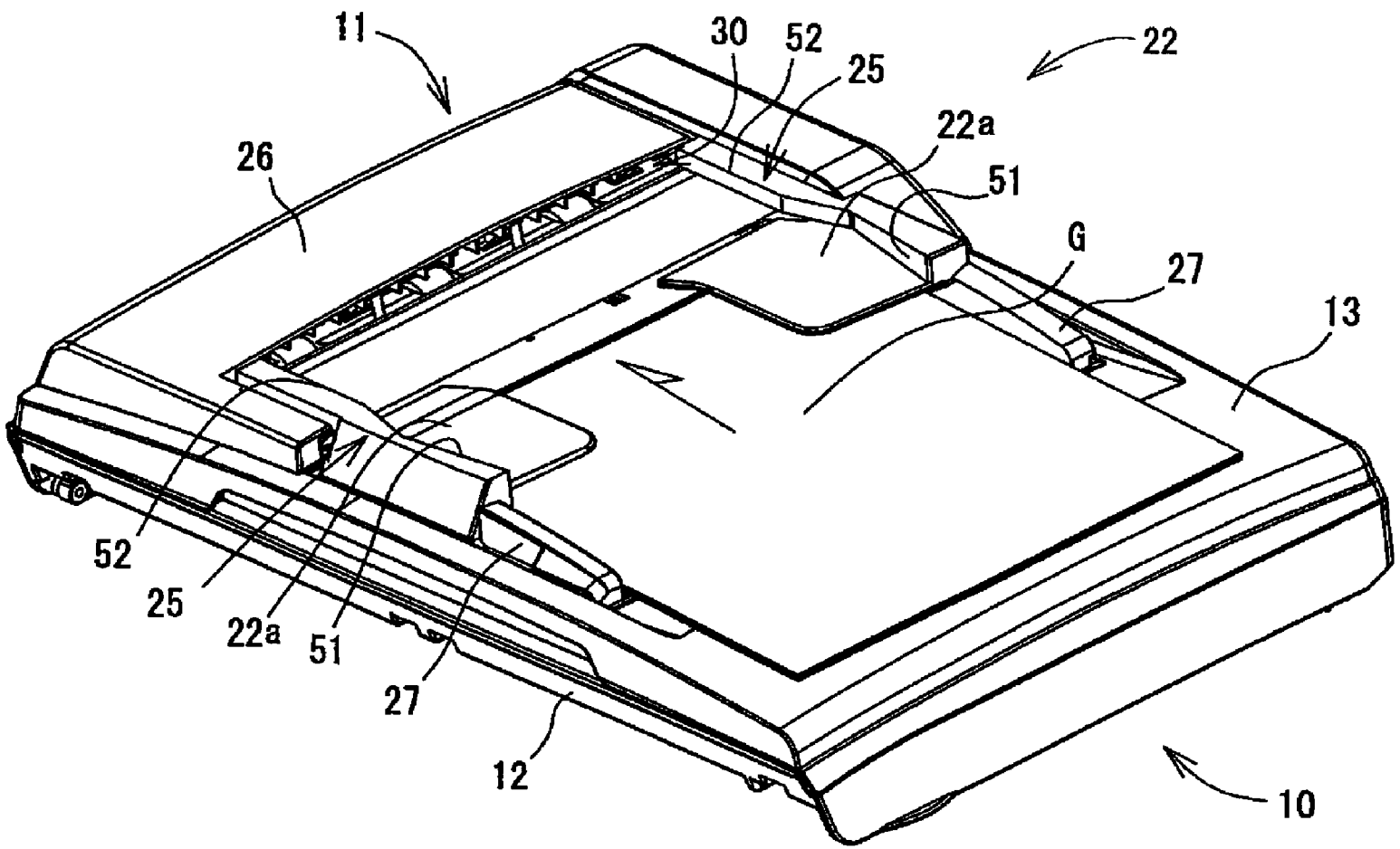
FIG. 4 is a perspective view for explaining a feed operation of feeding a document sheet.

When the image reading is conducted using the ADF 11, the document cover 13 is closed down over the document supporting base 12, as shown in FIG. 1. In this state, a plurality of document sheets G whose images are to be read are placed on the sheet-supplying tray 21, as shown in FIG. 4. When the document sheets G are placed on the sheet-supplying tray 21, the pair of sheet-supply guides 27 are moved or slid to the respective slide positions that correspond to the width of the document sheets G. The document sheets G are placed on the sheet-supplying tray 21 with the widthwise opposite side edges thereof aligned with each other and guided by the sheet-supply guides 27. A first-page document sheet G1 of the plurality of document sheets G whose image is to be first read is located at a lowermost position in the stack of the document sheets G. The document sheets G are placed facedown on the sheet-supplying tray 21, such that image-recorded surfaces of the document sheets G face downward. The leading end portions of the document sheets G in the sheet-feed direction are inserted into the pull-in chute portion 28.

The document sheets G inserted into the pull-in chute portion 28 come into contact with the pull-in roller 34 and pull-in nip member 35. In this respect, the pull-in roller 34 can rotate freely over one circumference in the sheet-feed direction as described above. Accordingly, the document sheets G allow the pull-in roller 34 to rotate freely in the sheet-feed direction and the pull-in nip member 35 to retract against the elastic force of the spring, so that the document sheets G are inserted to such an extent that the leading end portions thereof come into abutting contact with the separation roller 36 and the nip member 37. Thus, the document G are set on the sheet-supplying tray 21.

Subsequently, a command to initiate the image reading is inputted to the image reading device 10. The inputting of the command is performed through a start button disposed on an operation panel of the image reading device 10, a software program executed by a computer electrically connected to the image reading device 10, for instance. The operation panel and the computer are not shown.

When the command to initiate the image reading is inputted, the motor of the image reading device 10 is driven, whereby the pull-in roller 34 and the separation roller 36 are rotated. Further, the carriage 17 is moved by the moving mechanism to a position at which the carriage 17 is opposed to the sheet pressing member 31, as shown in FIG. 3. Thus, the CIS 16 is opposed to the sheet pressing member 31. Although the stack of document sheets G is pressed as a unit by the nip member 35 toward the pull-in roller 34, only a lowermost one 18 of the stack of the document sheets G is in contact with the roller surface of the pull-in roller 34. Accordingly, only the lowermost document sheet 18 receives the rotational force of the pill-in roller 34 and is fed in the sheet-feed direction. The document sheet 18 is pressed onto the roller surface of the separation roller 36 by the nip member 37, receives the rotational force of the separation roller 36, and is fed further in the sheet-feed direction. Thus, only the lowermost document sheet 18 among the plurality of document sheets G stacked on the sheet-supplying tray 21 is separated from the stack of the document sheets G and is fed into the sheet-feed path 23.

The document sheet 18 fed into the sheet-feed path 23 is nipped by the feed roller 38 and the pinch roller 39 and fed farther by the rollers 38, 39. Then the document sheet 18 is guided onto the platen glass 14 by the sheet pressing member 31. While not shown in FIG. 3, in the process in which the leading end portion of the document sheet 18 reaches the platen glass 14, a sensor detects the leading end portion of the document sheet 18, and it is judged that the leading end portion of the document sheet 18 reaches the platen glass 14 based on the rotational amount of the feed roller 38. When the leading end portion of the document sheet 18 reaches the platen glass 14, the CIS 16 starts to read the image of the document sheet 18 passing over the platen glass 14.

The document sheet 18 is fed farther while the image thereof is read by the CIS 16, and is then fed in a U-turned manner so as to turn around along the curved portion 29 with the leading end portion of the document sheet 18 nipped by the feed roller 40 and the pinch roller 41 and with the trailing end portion of the document sheet 18 nipped by the feed roller 38 and the pinch roller 39. The image reading by the CIS 16 continues to be performed on the document passing over the platen glass 14 during the U-turned feeding of the document sheet 18. Subsequently, the above-indicated sensor detects the trailing end portion of the document sheet 18, and it is judged that the trailing end portion of the document sheet 18 reaches the platen glass 14 based on the rotational amount of the feed roller 38. When the trailing end portion of the document sheet 18 passes past the platen glass 14, the image reading by the CIS 16 performed on the document sheet 18 is completed.

The document sheet 18 which is fed while being nipped by the feed roller 40 and the pinch roller 41 is fed farther through the discharge chute portion 30 toward the sheet-receiving tray 22 while being nipped by the feed roller 38 and the pinch roller 42. When the leading end portion of the document sheet 18 nipped by the feed roller 38 and the pinch roller 42 comes into contact with the guide surface 44 of the trailing-end supporting member 43, the leading end portion of the document sheet 18 is guided upward along the guide surface 44 while the trailing-end supporting member 43 elastically deforms due to the toughness of the document sheet 18 and moves downward. The elastic deformation of the trailing-end supporting member 43 reduces a load that acts on the document sheet 18 being fed by the feed roller 38 and the pinch roller 42, thereby avoiding sheet jamming which would arise from contacting of the document sheet 18 with the trailing-end supporting member 43.

Figure 5:
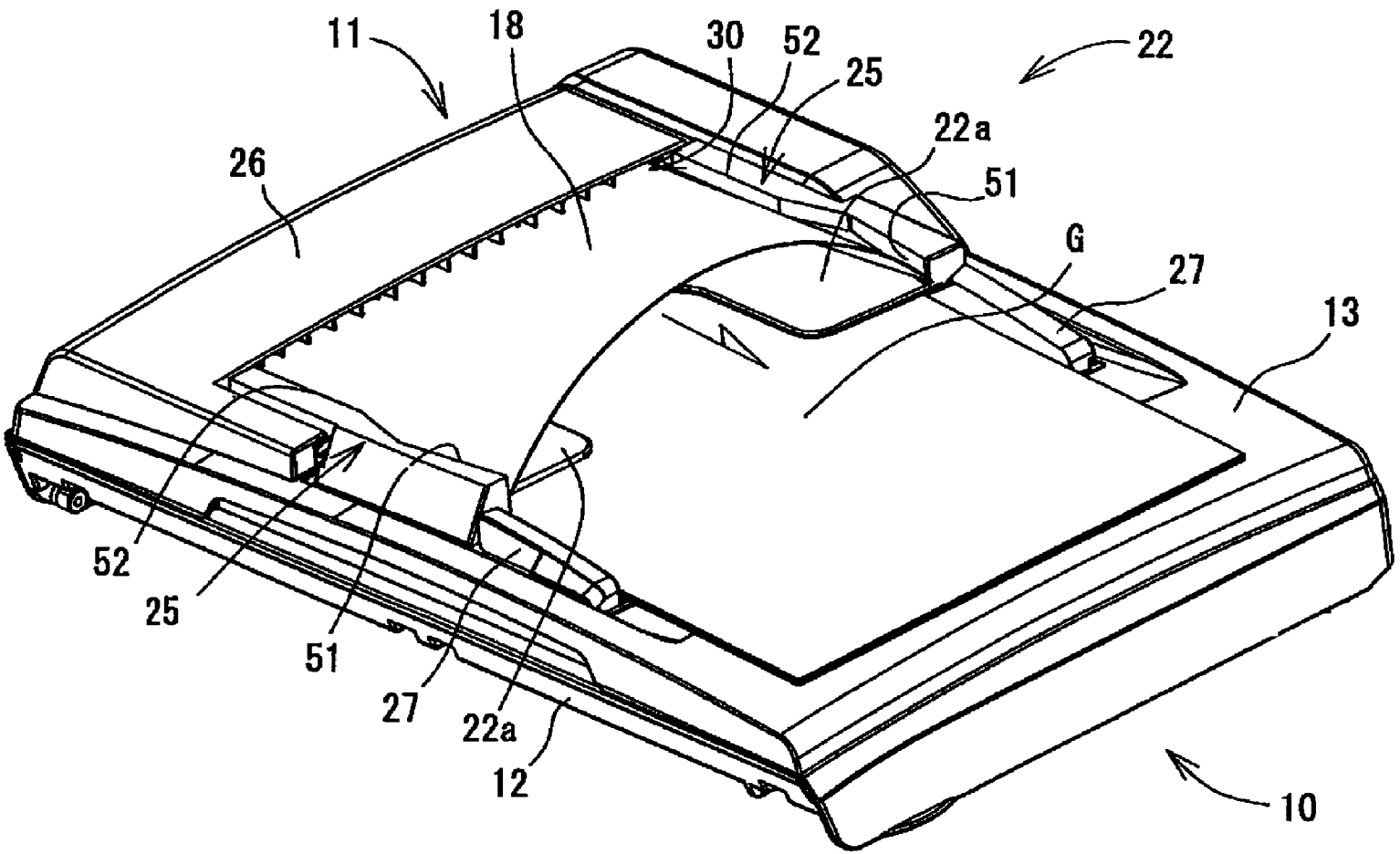
FIG. 5 is a perspective view for explaining the feed operation of feeding the document sheet.

As shown in FIG. 5, the document sheet 18 fed by the feed roller 38 and the pinch roller 42 is ejected from the casing 26 and slides on the sheet-receiving tray 22. As mentioned above, because the pair of sheet-supply guides 27 are located at the prescribed slide positions corresponding to the width of the document sheet 18, the distance L2 between the first guide portions 51 at the upstream ends thereof as seen in the sheet-feed direction is equal to the width of the document sheet 18. Accordingly, the document sheet 18 is discharged to the sheet-receiving tray 22 with its widthwise opposite side edges being in contact with the corresponding first guide portions 51.

The distance between the first guide portions 51 gradually becomes smaller toward the downstream ends thereof as seen in the sheet-feed direction. Therefore, the document sheet 18 which is fed with its widthwise opposite side edges being in contact with the respective first guide portions 51 tends to warp in the direction perpendicular to the sheet-feed direction. On the upstream side of the first guide portions 51 as seen in the sheet-feed direction, the second guide portions 52 overlie the corresponding widthwise opposite end portions of the document sheet 18. Accordingly, the upper surface of the document sheet 18 is in contact, at the widthwise opposite end portions thereof, with the corresponding second guide portions 52. Therefore, the second guide portions 52 prevent the widthwise opposite end portions of the document sheet 18 from lifting or floating upward beyond the second guide portions 52. Further, because no elements or members, such as a part of the casing 26, are present between the second guide portions 52, the widthwise central portion of the document sheet 18 as seen in the sheet-feed direction is allowed to move upward. Thus, the document sheet 18 warps such that its widthwise central portion is located at a higher position than its widthwise opposite end portions.

Figure 6:
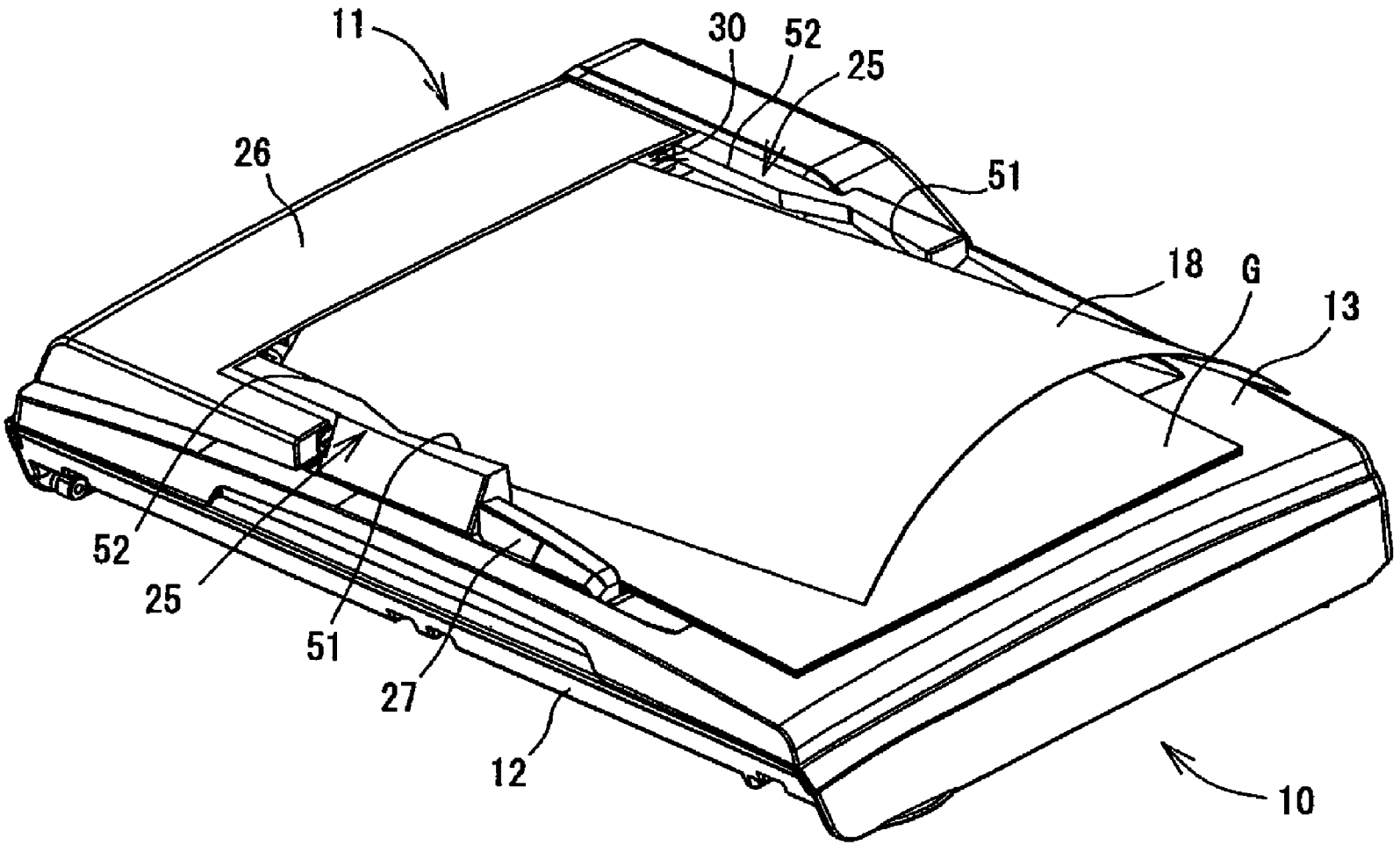
FIG. 6 is a perspective view for explaining the feed operation of feeding the document sheet.

The document sheet 18 ejected from the casing 26 onto the sheet-receiving tray 22 is kept in the warped state shown in FIG. 6 in which its widthwise central portion is located at a higher position than its widthwise opposite end portions, owing to the first guide portions 51 and the second guide portions 52. The thus warped document sheet 18 exhibits toughness in the sheet-feed direction. Further, as shown in FIG. 6, the trailing end portion of the document sheet 18 is not completely discharged from the discharge chute portion 30 in the casing 26, but is supported by the trailing-end supporting member 43 at a higher position than the nip position between the feed roller 38 and the pinch roller 42.

Figure 7:
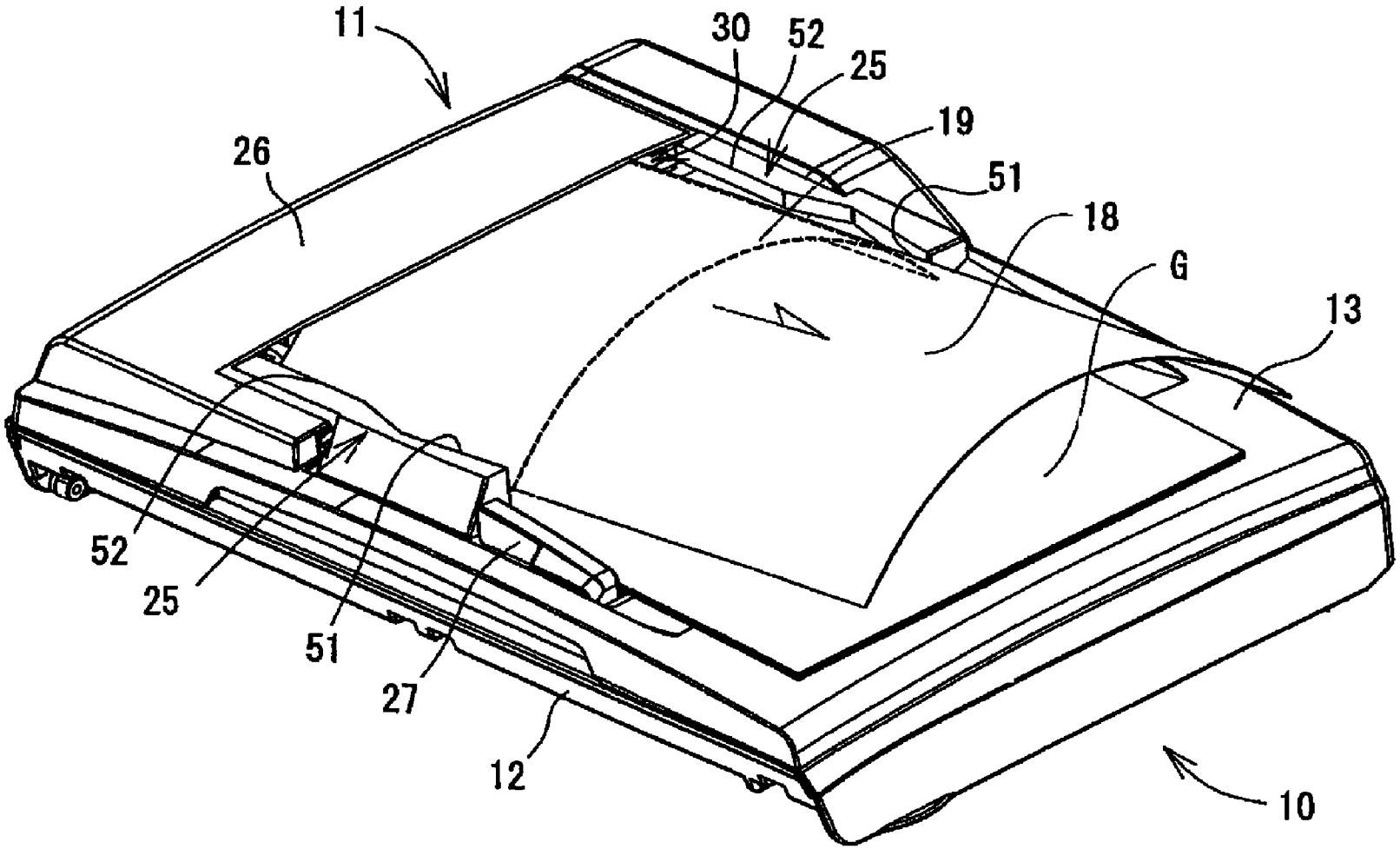
FIG. 7 is a perspective view for explaining the feed operation of feeding the document sheet.

Subsequent to the first-page document sheet 18, a second-page document sheet 19 is similarly fed from the sheet-supplying tray 21 into the sheet-feed path 23. The image of the second-page document sheet 19 is read by the CIS 16 on the platen glass 14, and the document sheet 19 is fed while being nipped by the feed roller 38 and the pinch roller 42. Since the trailing end portion of the first-page document sheet 18 is supported by the trailing-end supporting member 43 at a higher position than the nip position between the feed roller 38 and the pinch roller 42 as described above, the leading end portion of the second-page document sheet 19 is guided by the guide surface 44 of the trailing-end supporting member 43 and slides under the first-page document sheet 18. Subsequently the second-page document sheet 19 is discharged to the sheet-receiving tray 22 under the first-page document sheet 18, as shown in FIG. 7. In FIG. 7, the second-page document sheet 19 is indicated by a broken line.

Thus, the plurality of document sheets G placed facedown on the sheet-supplying tray 21 are separated one by one in order starting from the lowermost document sheet in the stack of the document sheets G. The separated sheets are sequentially fed to the sheet-receiving tray 22 through the sheet-feed path 23 and are sequentially discharged faceup onto the sheet-receiving tray 22 in the order in which the document sheets G have been stacked on the sheet-supplying tray 21. Thus, the order of the document sheets G remains unchanged before and after the feeding through the sheet-feed path 23.

The first-page document sheet 18 warped by the first guide portions 51 and the second guide portions 52 exhibits toughness, and the second-page document sheet 19 similarly warped also exhibits toughness, so that the second-page document sheet 19 smoothly slides under the first-page document sheet 18 on the sheet-receiving tray 22.

Since the warped first-page document sheet 18 exhibits toughness as described above, the first-page document sheet 18 that protrudes from the sheet-receiving tray 22 is prevented from drooping downward at its leading end portion as seen in the sheet-feed direction. If the leading end portion of the first-page document sheet 18 drooped downward, the leading end portion of the second-page document sheet 19 would abut on the drooped leading end portion of the first-page document sheet 18, thereby applying a large load with respect to the feeding of the second-page document sheet 19. The load will increase with an increase in the number of the documents G successively stacked on the sheet-receiving tray 22. In the end, an "n"-th-page document sheet Gn cannot be normally discharged due to the load, and the sheet jamming would occur.

The document sheets G warped as described above on the sheet-receiving tray 22 exhibit toughness, so that the document sheets G can be stacked on the sheet-receiving tray 22 while preventing the leading end portions thereof that protrudes from the sheet-receiving tray 22 from drooping downward, thereby making it possible to reduce the load applied to the feeding of the document sheets to be subsequently discharged. Accordingly, the arrangement allows the document sheets G to be smoothly discharged to the sheet-receiving tray 22 and increases the number of the document sheets G that can be successively fed by the ADF 11.

As described above, the first guide portions 51 and the second guide portions 52 are slidable such that the distance between the first guide portions 51 and the distance between the second guide portions 52 as measured in the direction perpendicular to the sheet-feed direction are changeable, whereby the above-described advantages can be obtained for various sizes of the document sheets G.

Further, since the first guide portions 51 and the second guide portions 52 move together with or interdependently with each other, the first guide portions 51 and the second guide portions 52 can be slid at a time to the respective prescribed slide positions corresponding to the width of the document sheets G to be fed, simply by moving either one of the first guide portions 51 and the second guide portions 52. Moreover, since the first guide portions 51 and the second guide portion 52 move together with or interdependently with the sheet-supply guides 27, the first guide portions 51, the second guide portions 52, and the sheet-supply guides 27 can be slid at a time to the respective prescribed slide positions corresponding to the width of the document sheets G to be fed, simply by moving any one of the first guide portions 51, the second guide portions 52, and the sheet-supply guides 27. Accordingly, the operability of the ADF 11 can be enhanced.

Second Embodiment

There will be next explained a second embodiment of the invention. The second embodiment differs from the illustrated first embodiment in the structure of the sheet-discharge guides. Accordingly, the second embodiment will be explained only in terms of the structure of the sheet-discharge guides with reference to FIGS. 8 and 9, and the same reference numerals as used in the illustrated first embodiment are used in the second embodiment to identify the corresponding components.

Figure 8:
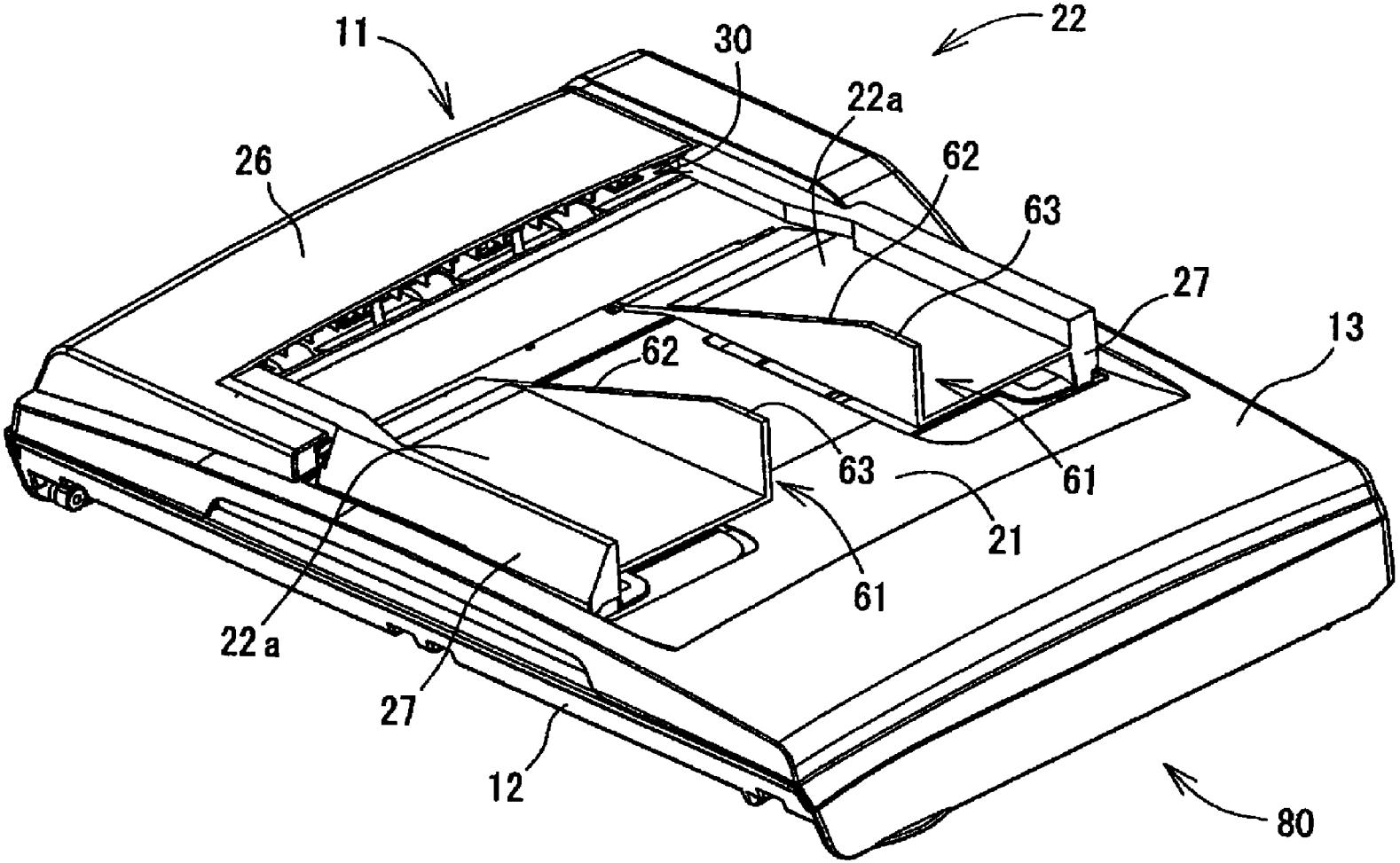
FIG. 8 is a perspective view showing an image reading device according to a second embodiment of the invention.

The perspective view of FIG. 8 shows an image reading device 80 according to the second embodiment. The sheet-discharge guides of the second embodiment each as a fourth guide indicated at 61 in FIG. 8 differ from the sheet-discharge guides 25 of the illustrated first embodiment in that the sheet-discharge guides 61 can come into contact with the lower surface of the widthwise central portion of each of the document sheets G discharged to the sheet-receiving tray 22, so as to warp each of the document sheets G in the direction perpendicular to the sheet-feed direction.

Figure 9:
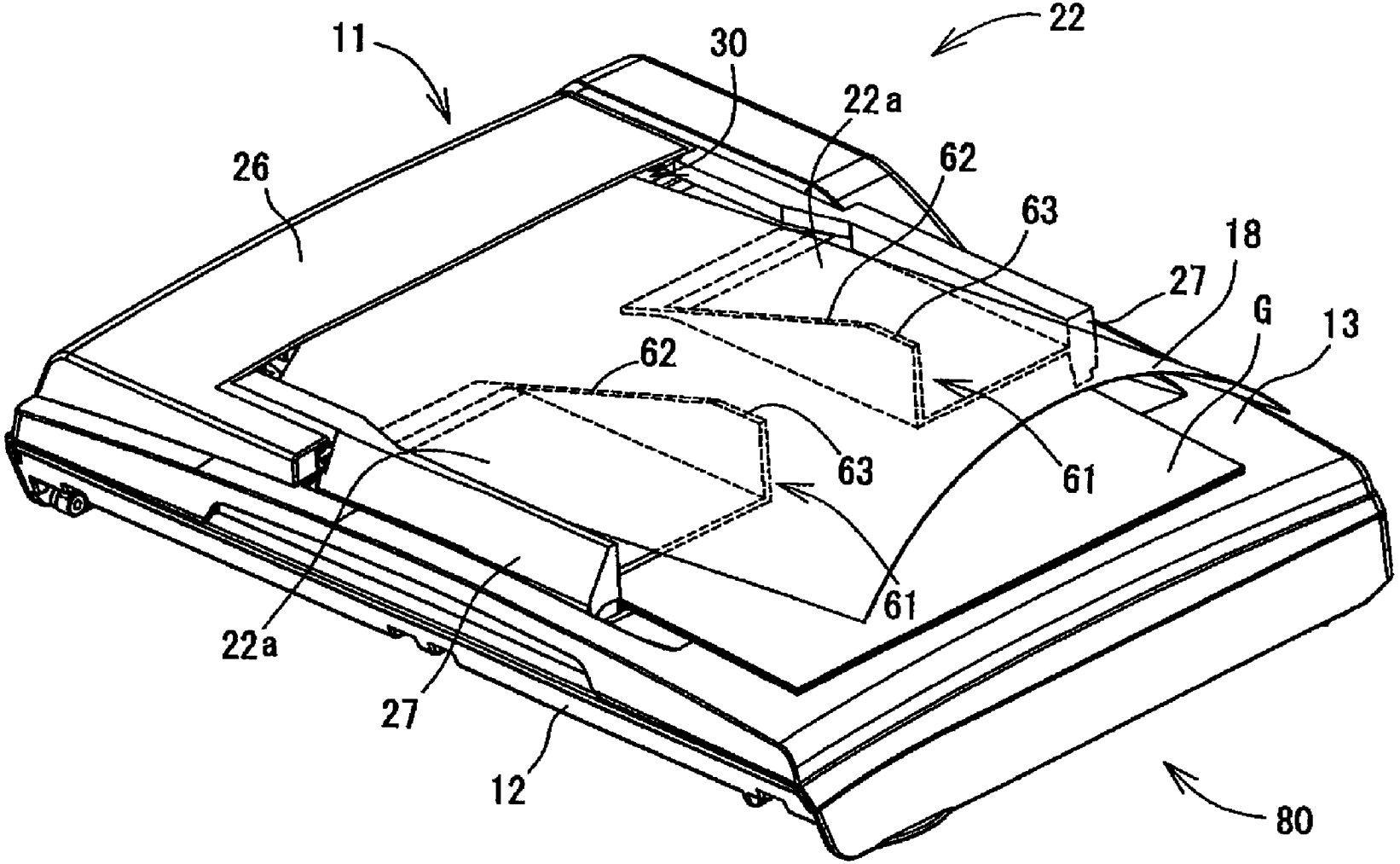
FIG. 9 is a perspective view for explaining a state in which a document sheet is discharged.

As shown in FIG. 8, the sheet-discharge guides 61 are provided as a pair integrally with the respective tray plates 22*a* of the sheet-receiving tray 22. More specifically explained, the sheet-discharge guides 61 are formed integrally with the respective sheet-supply guides 27, together with the tray plates 22*a* of the sheet-receiving tray 22. Each of the document sheets G discharged to the sheet-receiving tray 22 is warped by the sheet-discharge guides 61 such that the widthwise central portion of each document sheet G is located at a higher position than the widthwise opposite end portions thereof, as shown in FIG. 9.

The sheet-discharge guides 61 are formed on the respective tray plates 22*a* of the sheet-receiving tray 22 so as to extend in the sheet-feed direction, such that each sheet-discharge guide 61 in the form of a wall stands upright from one of opposite ends of the corresponding tray plate 22*a*, which one end is nearer to the center side of the image reading device 80 as seen in the direction perpendicular to the sheet-feed direction. The sheet-discharge guides 61 respectively provided on one and the other of the two tray plates 22*a* of the sheet-receiving tray 22 are symmetric relative to each other in the direction perpendicular to the sheet-feed direction and are identical in construction with each other. Accordingly, the construction of one of the sheet-discharge guides 61 will be hereinafter given.

The sheet-discharge guide 61 has an upper surface that functions as a guide surface for guiding each of the document sheets G. The guide surface consists of an inclined portion 62 and a horizontal portion 63 which are smoothly continuous or connected to each other in the sheet-feed direction, such that the inclined portion 62 is located on more upstream in the sheet-feed direction than the horizontal portion 63.

The inclined portion 62 is inclined upward so as to have a height which gradually increases from its upstream end toward its downstream end. That is, the inclined portion 62 has a lower end at its upstream end and an upper end at its downstream end. The lower end of the inclined portion 62 is located at a lower position than the nip position of the feed roller 38 and the pinch roller 42. Accordingly, each of the document sheets G to be discharged to the sheet-receiving tray 22 while being nipped between the feed roller 38 and the pinch roller 42 comes into contact with, at the leading end portion thereof, the inclined portions 62 of the respective sheet-discharge guides 61.

The horizontal portion 63 of each sheet-discharge guide 61 has a horizontal surface which is located at the same level as the upper end of the inclined portion 62 and at a higher position than the upper surface of the sheet-receiving tray 22. A height difference between the horizontal portion 63 and the upper surface of the sheet-receiving tray 22 is determined depending upon a desired amount of warpage of the document sheets G. That is, where it is desired to warp the document sheets G to a large extent, the height difference between the horizontal portion 63 and the upper surface of the sheet-receiving tray 22 is made large.

As shown in FIG. 9, the document sheet 18 discharged to the sheet-receiving tray 22 comes into contact, at its widthwise central portion of the leading end, with the inclined portions 62 of the sheet-discharge guides 61, and is lifted upward along the inclined portions 62. On the other hand, the widthwise opposite end portions of the document sheet 18 slide on the sheet-receiving tray 22. Accordingly, there arises a height difference between the widthwise central portion of the document sheet 18 and the widthwise opposite end portions thereof, so that the document sheet 18 warps such that its widthwise central portion is located at a higher position than its widthwise opposite end portions, as shown in FIG. 9. The document sheet 18 discharged to the sheet-receiving tray 22 is kept warped while being supported by the horizontal portions 63 of the respective sheet-discharge guides 61. While not shown in FIG. 9, the document sheet 19 to be subsequently discharged similarly warps and is discharged so as to slide under the document sheet 18. Thus, the second embodiment offers the same advantages as those in the illustrated first embodiment.

Third Embodiment

There will be next explained a third embodiment of the invention. The third embodiment differs from the illustrated first embodiment in the structure of the sheet-discharge guides. Accordingly, the third embodiment will be explained only in terms of the structure of the sheet-discharge guides with reference to FIGS. 10 and 11, and the same reference numerals as used in the illustrated first embodiment are used in the third embodiment to identify the corresponding components.

Figure 10:
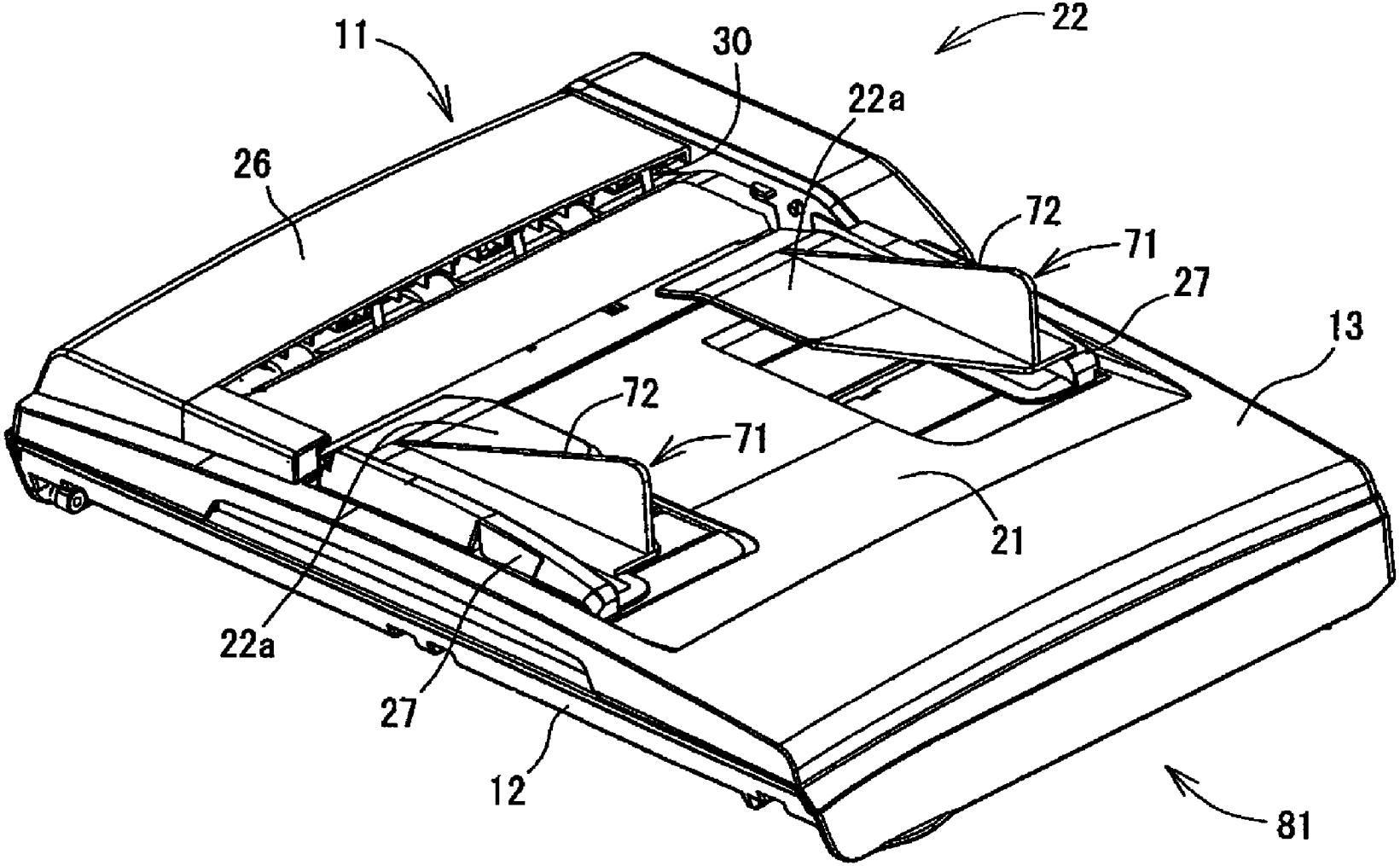
FIG. 10 is a perspective view showing an image reading device according to a third embodiment of the invention.

The perspective view of FIG. 10 shows an image reading device 81 according to the third embodiment. The sheet-discharge guides indicated at 71 in FIG. 10 can come into contact with the lower surface of the widthwise opposite end portions of each of the document sheets G discharged to the sheet-receiving tray 22, so as to warp each of the document sheets G in the direction perpendicular to the sheet-feed direction.

As shown in FIG. 10, the sheet-discharge guides 71 are provided as a pair integrally with the respective tray plates 22*a* of the sheet-receiving tray 22. More specifically explained, the sheet-discharge guides 71 are formed integrally with the respective sheet-supply guides 27, together with the tray plates 22*a* of the sheet-receiving tray 22. Each of the document sheets G discharged to the sheet-receiving tray 22 is warped by the sheet-discharge guides 71 such that the widthwise opposite end portions of each document sheet G are located at a higher position than the widthwise central portion thereof, as shown in FIG. 11.

The sheet-discharge guides 71 are formed on the respective tray plates 22*a* of the sheet-receiving tray 22 so as to extend in the sheet-feed direction, such that each of the sheet-discharge guides 71 in the form of a wall stands upright from the other of the opposite ends of the corresponding tray plate 22*a*, which other end is remote from the center side of the image reading device 81 as seen in the direction perpendicular to the sheet-feed direction. The sheet-discharge guides 71 respectively provided on one and the other of the two tray plates 22*a* of the sheet-receiving tray 22 are symmetric relative to each other in the direction perpendicular to the sheet-feed direction and are identical in construction with each other. Accordingly, the construction of one of the sheet-discharge guides 71 will be hereinafter given.

The sheet-discharge guide 71 has an upper surface 72 that functions as a guide surface for guiding each of the document sheets G. The upper surface 72 is inclined upward so as to have a height which gradually increases from its upstream end toward its downstream end thereof as seen in the sheet-feed direction. That is, the upper surface 72 has a lower end at its upstream end and an upper end at its downstream end. The lower end of the upper surface 72 is continuous or connected to the upper surface of the sheet-receiving tray 22. Accordingly, each of the document sheets G to be discharged to the sheet-receiving tray 22 while being nipped between the feed roller 38 and the pinch roller 42 is picked up or scooped upward, at its leading end, by the upper surfaces 72 of the respective sheet-discharge guides 71.

Figure 11:
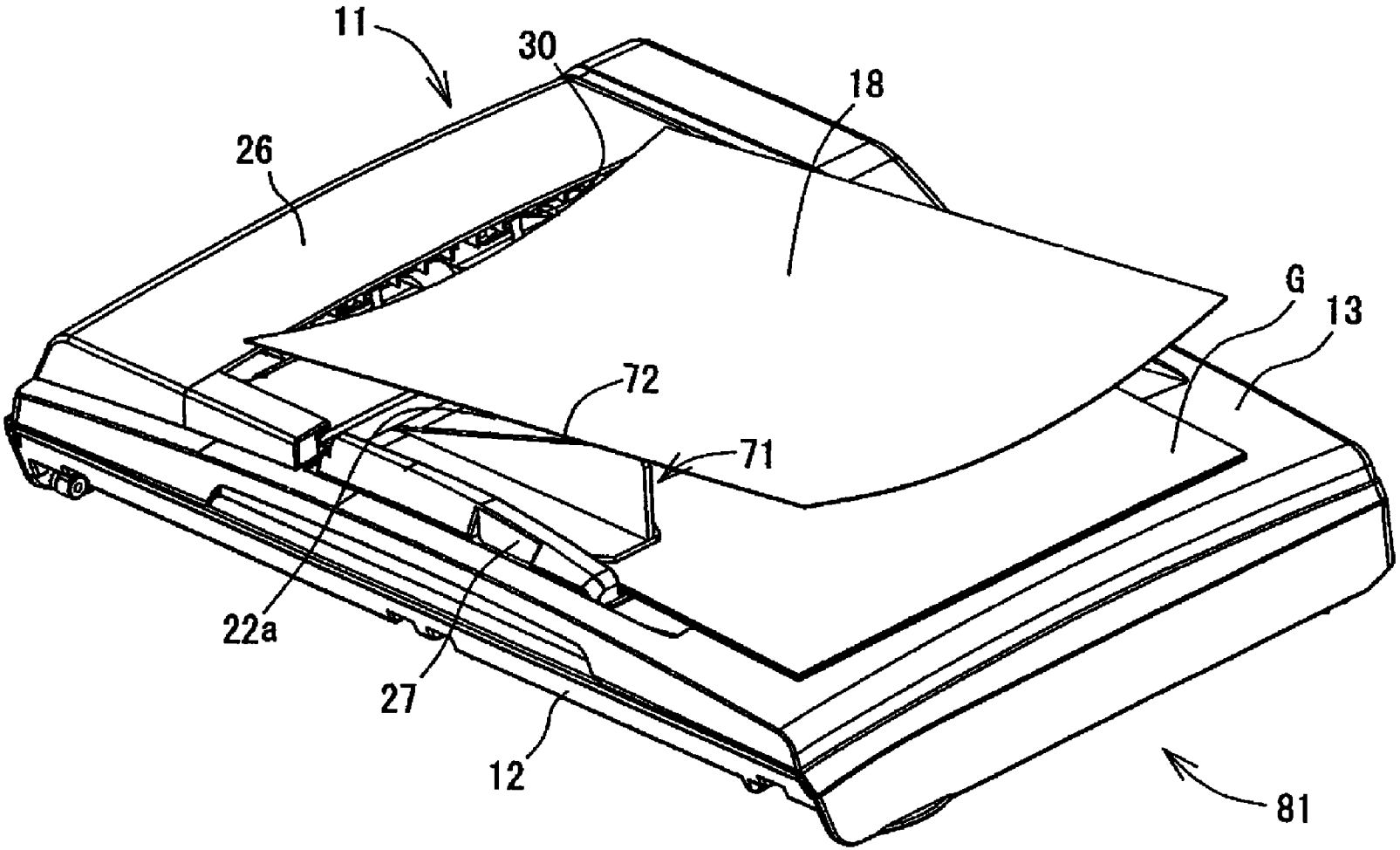
FIG. 11 is a perspective view for explaining a state in which a document sheet is discharged.

As shown in FIG. 11, the document sheet 18 discharged to the sheet-receiving tray 22 comes into contact, at its widthwise opposite end portions of the leading end, with the upper surfaces 72 of the respective sheet-discharge guides 71, and is picked up or scooped upward. On the other hand, the widthwise central portion of the document sheet 18 is not supported and is allowed to displace downward between the tray plates 22*a* of the sheet-receiving tray 22. Accordingly, there arises a height difference between the widthwise central portion of the document sheet 18 and the widthwise opposite end portions thereof, so that the document sheet 18 warps such that its widthwise opposite end portions are located at a higher position than its widthwise central portion, as shown in FIG. 11. The document sheet 18 discharged to the sheet-receiving tray 22 is kept warped while being supported by the upper surfaces 72 of the sheet-discharge guides 71. While not shown in FIG. 11, the document sheet 19 to be subsequently discharged similarly warps and is discharged so as to slide under the document sheet 18. Thus, the third embodiment offers the same advantages as those in the illustrated first embodiment.

It is to be understood that the invention is not limited to the details of the illustrated embodiments, but may be embodied with various changes and modifications, which may occur to those skilled in the art, without departing from the spirit and scope of the invention defined in the attached claims.

What is claimed is:

1. A sheet feeding device, comprising:

a first tray on which sheets to be fed are stacked;

a second tray which is disposed above the first tray to provide a two-tier structure and on which the sheets after having fed from the first tray are stacked;

a sheet-feed path extending from the first tray to the second tray;

a sheet-feed mechanism which is operable to separate one of the sheets stacked on the first tray, to feed the one of the sheets into the sheet-feed path, and to discharge the one of the sheets to the second tray such that the one of the sheets slides under another of the sheets that has been discharged immediately before the one of the sheets; and at least one sheet guide which is configured to warp each of the sheets discharged to the second tray such that a central portion of said each of the sheets as seen in the direction perpendicular to the sheet-feed direction is located at a higher position than end portions of said each of the sheets as seen in the direction perpendicular to the sheet-feed direction, wherein the at least one sheet guide includes: a pair of first guides which extend along the sheet-feed direction so as to respectively contact side edges of said each of the sheets discharged to the second tray and which are configured such that a distance between the pair of first guides gradually becomes smaller in the sheet-feed direction than a dimension of the sheets as measured in the direction perpendicular to the sheet-feed direction; and a pair of second guides which are configured to respectively overlie the end portions of an uppermost one of the sheets discharged to the second tray so as to respectively contact an upper surface of the uppermost one of the sheets at the end portions thereof.

2. The sheet feeding device according to claim 1, wherein the pair of first guides and the pair of second guides are configured to be slidable such that the distance between the pair of first guides as measured in the direction perpendicular to the sheet-feed direction and a distance between the pair of second guides as measured in the direction perpendicular to the sheet-feed direction are changeable.

3. The sheet feeding device according to claim 2, wherein the pair of first guides and the pair of second guides are configured to move interdependently with each other.

4. The sheet feeding device according to claim 3, further comprising a pair of third guides which are disposed on the first tray so as to extend along the sheet-feed direction and so as to be slidable such that a distance between the pair of third guides as measured in the direction perpendicular to the sheet-feed direction is changeable and which are configured to respectively contact, at respective slide positions, side edges of each of the sheets stacked on the first tray, wherein the pair of third guides are configured to move interdependently with the pair of first guides and the pair of second guides.

5. The sheet feeding device according to claim 4, wherein the at least one sheet guide includes a fourth guide which is configured to contact a lower surface of the central portion of said each of the sheets discharged to the second tray and to have a height that gradually increases in the sheet-feed direction.

6. The sheet feeding device according to claim 1, wherein the second tray has a dimension as measured in the sheet-feed direction that is smaller than a dimension of the sheets as measured in the sheet-feed direction.

7. The sheet feeding device according to claim 1, wherein the sheet-feed mechanism includes: a pair of rollers operable to nip each of the sheets therebetween for discharging said each of the sheets to the second tray; and a trailing-end supporting member which is disposed on a downstream side of the pair of rollers in the sheet-feed direction and which is configured to push up and support a trailing end portion of a lowermost one of the sheets discharged to the second tray, at a position higher than a position at which the pair of rollers nip said each of the sheets therebetween.

8. The sheet feeding device according to claim 7, wherein the trailing-end supporting member is configured to be elastically deformed downward by contact thereof with said each of the sheets discharged by the pair of rollers.

9. The sheet feeding device according to claim 1, wherein the sheet-feed mechanism is configured to feed, into the sheet-feed path, a lowermost one of the sheets that are stacked on the first tray.

10. The sheet feeding device according to claim 1, wherein the sheet-feed path is a U-turned path in which the one of the sheets that are stacked on the first tray is turned around upward and is guided toward the second tray.

11. An image reading device comprising: the sheet feeding device defined in claim 1; and an image reading portion configured to read an image recorded on each of the sheets fed through the sheet-feed path.

12. A sheet feeding device, comprising:

a first tray on which sheets to be fed are stacked;

a second tray which is disposed above the first tray to provide a two-tier structure and on which the sheets after having fed from the first tray are stacked;

a sheet-feed path extending from the first tray to the second tray;

a sheet-feed mechanism which is operable to separate one of the sheets stacked on the first tray, to feed the one of the sheets into the sheet-feed path, and to discharge the one of the sheets to the second tray such that the one of the sheets slides under another of the sheets that has been discharged immediately before the one of the sheets; and at least one sheet guide which is configured to warp each of the sheets discharged to the second tray such that a central portion of said each of the sheets as seen in the direction perpendicular to the sheet-feed direction is located at a higher position than end portions of said each of the sheets as seen in the direction perpendicular to the sheet-feed direction, wherein the at least one sheet guide includes:

a pair of first guides which extend along the sheet-feed direction so as to respectively contact side edges of said each of the sheets discharged to the second tray and which are configured such that a distance between the pair of first guides gradually becomes smaller in the sheet-feed direction than a dimension of the sheets as measured in the direction perpendicular to the sheet-feed direction;

a pair of second guides which are configured to respectively overlie the end portions of an uppermost one of the sheets discharged to the second tray so as to respectively contact an upper surface of the uppermost one of the sheets at the end portions thereof; and a particular guide which is configured to contact a lower surface of the central portion of said each of the sheets discharged to the second tray and to have a height that gradually increases in the sheet-feed direction.

* * * * *